US009287615B2

(12) United States Patent
Cook et al.

(10) Patent No.: US 9,287,615 B2
(45) Date of Patent: Mar. 15, 2016

(54) MULTI-MODE SIGNAL SOURCE

(71) Applicant: RAYTHEON COMPANY, Waltham, MA (US)

(72) Inventors: David C. Cook, Oro Valley, AZ (US); Patrick L. McCarthy, Tucson, AZ (US); John Okerson Crawford, Vail, AZ (US); David A. Faulkner, Tucson, AZ (US); Dylan William Rohyans Martin, Tucson, AZ (US); Nicholas D. Trail, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 285 days.

(21) Appl. No.: 13/803,402

(22) Filed: Mar. 14, 2013

(65) Prior Publication Data

US 2014/0266934 A1 Sep. 18, 2014

(51) Int. Cl.

| | |
|---|---|
| ***H01Q 5/00*** | (2015.01) |
| ***H01Q 13/02*** | (2006.01) |
| ***H01Q 1/44*** | (2006.01) |
| ***H01Q 5/22*** | (2015.01) |
| ***H01P 1/161*** | (2006.01) |
| ***H01Q 13/06*** | (2006.01) |

(52) U.S. Cl.

CPC ..... *H01Q 1/44* (2013.01); *H01P 1/161* (2013.01); *H01Q 5/22* (2015.01); *H01Q 13/0208* (2013.01); *H01Q 13/06* (2013.01); *H01Q 13/065* (2013.01)

(58) Field of Classification Search

CPC . H01Q 13/02; H01Q 13/025; H01Q 13/0258; H01Q 13/06; H01Q 5/20; H01Q 5/22; H01Q 5/28

USPC ..... 343/772, 786, 721; 359/896

See application file for complete search history.

(56) References Cited

U.S. PATENT DOCUMENTS

| | | | | |
|---|---|---|---|---|
| 2,892,982 | A * | 6/1959 | Allen | 333/117 |
| 3,274,603 | A * | 9/1966 | Kay | 343/781 R |
| 4,228,410 | A * | 10/1980 | Goudey et al. | 333/122 |
| 4,247,858 | A | 1/1981 | Eichweber | |
| 4,282,527 | A * | 8/1981 | Winderman et al. | 343/725 |
| 4,636,797 | A | 1/1987 | Saffold et al. | |
| 4,652,885 | A | 3/1987 | Saffold et al. | |
| 5,012,250 | A | 4/1991 | Foley | |
| 5,214,438 | A | 5/1993 | Brusgard et al. | |
| 5,635,944 | A * | 6/1997 | Weinstein et al. | 343/776 |
| 6,735,369 | B2 * | 5/2004 | Komachi et al. | 385/125 |
| 6,801,172 | B1 | 10/2004 | Schwengler | |

OTHER PUBLICATIONS

Navarrini et al, "A Turnstile Junction Waveguide Orthomode Transducer", Jan. 2006, IEEE, vol. 54, pp. 272-273.*

Aramaki, et al., "Ultra-Thin Broadband OMT with Turnstile Junction", IEEE MTT-S Digest, 2003, pp. 1-4.

Pisano, et al., "A Broadband WR10 Turnstile Junction Orthomode Transducer", IEEE Microwave and Wireless Components Letters, vol. 17, No. 4, Apr. 2007, pp. 1-3.

* cited by examiner

*Primary Examiner* — Robert Karacsony
*Assistant Examiner* — Patrick Holecek
(74) *Attorney, Agent, or Firm* — Lando & Anastasi, LLP

(57) ABSTRACT

A multimode radiation source is disclosed. One embodiment includes a waveguide radiator and an orthomode transducer coupled to the waveguide radiator to provide a first signal to the waveguide radiator. The waveguide radiator is configured to receive the first signal and to radiate the first signal at a first location as a first spherical wave signal with a first phase center. The multimode source also includes transmission medium coupled to the waveguide radiator and configured to radiate a second signal and a third signal from the first location as a second spherical wave and a third spherical wave with substantially the first phase center.

20 Claims, 6 Drawing Sheets

MULTI-MODE SIGNAL SOURCE

BACKGROUND

Current test systems for units under test (UUT) such as multi-mode seekers that operate at multiple wavelengths include a number of spatially distributed discrete signal sources that provide multiple wavelength signals and are subject to mis-alignment in position and angle. Typically these sources can not be easily co-located or angularly co-aligned. Alternatively, discrete tests can be performed at different test stations configured to operate at different wavelengths. However, such test facilities require either or both of significant metrology that allows the transfer of the optical axis of the measurement chamber of one sensor to each of the chambers of the other sensors, or significant floor space so as to move the sources far a-field from the multimode seeker UUT. Another known structure is disclosed in U.S. Pat. No. 5,012,250, which discloses an infrared (IR) radiator disposed in a center of an RF horn radiator to provide an IR and a radiofrequency (RF) source. However, such structure suffers from compromised performance due to numerous infirmities including blockage imposed by the IR source in the RF radiator.

SUMMARY OF INVENTION

Aspects and embodiments of the disclosure are directed to methods and apparatus for providing a multimode signal source that radiates multiple signals from a first location with substantially a common phase center. In particular, as discussed in more detail herein, certain embodiments are directed to providing at least two signals that are co-located, co-aligned so that the at least two signals are radiated in a same direction, and that are radiated with substantially a common phase center.

According to one embodiment, a multimode radiation source comprises a waveguide radiator having a first feed port for receiving a first signal having a first frequency and a first wavelength and for providing the first signal to the waveguide radiator so that the waveguide radiator radiates the first signal at a first location as a first spherical wave with a first phase center, a first transmission medium and a second transmission medium. The first transmission medium is configured to be coupled to a first source and is configured to receive the first signal and to provide the first signal to the first feed port of the waveguide radiator. The second transmission medium is configured to be coupled to a second source and is configured to provide a second signal having a second frequency and a second wavelength to the waveguide radiator so that the waveguide radiator radiates the second signal from substantially the first location as a second spherical wave with substantially the first phase center. The second transmission medium is further configured to be coupled to a third source and is configured to provide a third signal having a third frequency and a third wavelength to the waveguide radiator so that the waveguide radiator radiates the third signal from substantially the first location as a third spherical wave with substantially the first phase center.

According to one embodiment, a multimode radiation source comprises a waveguide radiator constructed and arranged to have a primary mode of operation over a first frequency range, a first transmission medium, and a second transmission medium. The waveguide radiator has a first feed port for receiving a first signal within the first frequency range and for providing the first signal to the waveguide radiator so that the waveguide radiator radiates the first signal at a first location as a first spherical wave with a first phase center. The first transmission medium is configured to be coupled to a first source and is coupled to the first feed port of the waveguide radiator. The first transmission medium is configured to receive the first signal at a first frequency and a first wavelength from the first source and to provide the first signal to the first feed port of the waveguide radiator so as to launch the first signal in the waveguide radiator. The second transmission medium is disposed at least in part within the waveguide radiator The second transmission medium is configured to receive a second signal at a second wavelength and a second frequency that is a plurality of orders of magnitude above the first frequency of the first signal and that is above the first frequency range of the waveguide radiator and is configured to propagate the second signal within the waveguide radiator and to radiate the second signal from substantially the first location as a second spherical wave with substantially the first phase center. The second transmission medium is further configured to receive a third signal at a third wavelength and a third frequency that is a plurality of orders of magnitude above the first frequency of the first signal and that is above the first frequency range of the waveguide radiator and is configured to propagate the third signal within the waveguide radiator and to radiate the third signal from substantially the first location as a second spherical wave with substantially the first phase center.

According to one embodiment, a multimode radiation source comprises a waveguide radiator constructed and arranged to have a primary mode of operation over a first frequency range, a first transmission medium and a second transmission medium. The waveguide radiator has a first feed port for receiving a first signal within the first frequency range and for providing the first signal to the waveguide radiator so that the waveguide radiator radiates the first signal at a first location as a first spherical wave with a first phase center. The first transmission medium is configured to be coupled to a first source and is coupled to the first feed port of the waveguide radiator The first transmission medium is configured to receive the first signal at a first frequency and a first wavelength from a first source and to provide the first signal to the first feed port of the waveguide radiator so as to launch the first signal in the waveguide radiator. The second transmission medium is disposed at least in part within the waveguide radiator and is configured to receive a second signal at a second wavelength and a second frequency that is a plurality of orders of magnitude above the first frequency of the first signal and that is above the first frequency range of the waveguide radiator and is configured to propagate the second signal within the waveguide radiator and to radiate the second signal from substantially the first location as a second spherical wave with substantially the first phase center. The second transmission medium is further configured to receive a third signal at a third wavelength and a third frequency that is a plurality of orders of magnitude above the first frequency of the first signal and that is above the first frequency range of the waveguide radiator and is configured to propagate the third signal within the waveguide radiator and to radiate the third signal from substantially the first location as a second spherical wave with substantially the first phase center.

According to one embodiment, a multimode radiation source comprises a waveguide radiator, an orthomode transducer and a transmission medium. The waveguide radiator is configured to receive a first signal at a first end of the waveguide radiator, to propagate the first signal along a transmission length of the waveguide radiator and to radiate the first signal at a first location at substantially a second end of the waveguide radiator as a first spherical wave with a first phase center. The orthomode transducer is coupled to the waveguide radiator at the first end of the waveguide radiator and is configured to provide the first signal to the waveguide radiator. The orthomode transducer has a first port configured to receive the first signal having a first polarization, has a second port configured to receive the first signal having a second polarization, wherein the first and second polarizations are orthogonal, and the orthomode transducer has a first wall orthogonal to the first and second ports and orthogonal to a transmission length of the waveguide radiator, the first wall comprising a third port for receiving a transmission medium. The transmission medium is coupled to the waveguide radiator through the third port. The transmission medium is configured to provide a second signal so that the waveguide radiator radiates the second signal from substantially the first location as a second spherical wave with substantially the first phase center, and is further configured to provide a third signal so that the waveguide radiator radiates the third signal from substantially the first location as a third spherical wave with substantially the first phase center.

According to one embodiment, a multimode radiation source comprises a waveguide radiator, a first source, a first transmission medium, a second source, a second transmission medium, and a third source. The waveguide radiator has a first feed port and a primary mode of operation over a first frequency range. The waveguide radiator is configured to radiate the first signal at a first location as a spherical wave with a first phase center. The first source is configured to provide a first signal at a first frequency and a first wavelength that is within the first frequency range of the waveguide radiator. The first transmission medium is coupled to the first source and to first feed port of the waveguide radiator and provides the first signal from the first source to first feed port of the waveguide radiator. The second source is configured to provide a second signal at a second wavelength and a second frequency that is a plurality of orders of magnitude above the first frequency of the first source and that is above the first frequency range of the waveguide radiator. The second transmission medium is coupled to the second source and is configured to provide the second signal to the waveguide radiator at the first location so as to radiate the second signal from substantially the first location as a spherical wave with substantially the first phase center. The third source is configured to provide a third signal at a third wavelength and a third frequency that is a plurality of orders of magnitude above the first frequency of the first source and that is above the first frequency range of the waveguide radiator. The second transmission medium is coupled to the third source and is configured to provide the third signal to the waveguide radiator at the first location so as to radiate the third signal from substantially the first location as a spherical wave with substantially the first phase center.

According to aspects and embodiments, the waveguide radiator is a circular waveguide. According to aspects and embodiments, the circular waveguide radiator is a scalar feed horn. According to aspects and embodiments, the scalar feed horn comprises annular choke rings.

According to aspects and embodiments, the multimode radiation source further comprises a waveguide orthomode transducer coupled to the waveguide radiator at the first feed port of the waveguide radiator, which is configured to provide the first signal to the waveguide radiator. The orthomode transducer has a first port in a first wall of the orthomode transducer configured to receive the first signal having a first E-plane polarization, a second port in a second wall of the orthomode transducer that is orthogonal to the first wall and that is configured to receive the first signal having a second E-plane polarization, wherein the first and second E-plane polarizations are orthogonal, The waveguide orthomode transducer has a third wall orthogonal to each of the first and second walls and that has a feed port for the second transmission media disposed therein. According to aspects and embodiments, the first transmission medium comprises a first waveguide having a first E-plane polarization coupled to the first port of the waveguide orthomode transducer and a second waveguide having a second E-plane polarization coupled to the second port of the waveguide orthomode transducer.

According to aspects and embodiments, the waveguide orthomode transducer comprises a turnstile junction waveguide orthomode transducer wherein the first port comprises first and third waveguide ports having the first E-plane polarization disposed in opposite first and second walls of the waveguide orthomode transducer, and wherein the second port comprises second and fourth waveguide ports having the second E-plane polarization disposed in third and fourth walls of the waveguide orthomode transducer that are orthogonal to the first and second walls, and wherein the turnstile junction waveguide orthomode transducer has a fifth wall orthogonal to each of the first, second, third and fourth walls and that has a feed port for the second transmission media disposed therein. According to aspects and embodiments, the first transmission medium comprises a first symmetrical waveguide coupled to the first port of the orthomode transducer having a first E-plane bend and having the first E-plane polarization, a second symmetrical waveguide coupled to the third port of the orthomode transducer having a second E-plane plane bend that is symmetrical to the first E-plane bend and having the first E-plane polarization, a first waveguide power combiner section that is coupled to the first E-plane bend and the second E-plane bend; a third symmetrical waveguide coupled to the second port of the orthomode transducer having a third E-plane bend and having the second E-plane polarization, a fourth symmetrical waveguide coupled to the fourth port of the orthomode transducer having a fourth E-plane plane bend that is symmetrical to the third E-plane bend and having the second E-plane polarization, and a second waveguide power combiner section that is coupled to the third E-plane bend and the fourth E-plane bend.

According to aspects and embodiments, the second transmission medium comprises an optical fiber having a distal end that is disposed substantially at the first location. According to aspects and embodiments, the optical fiber has a low dielectric constant outer annular foam jacket. According to aspects and embodiments, the optical fiber comprises an indium fluoride center conductor.

According to aspects and embodiments, the second transmission medium comprises a hollow optical pipe having a distal end that is disposed substantially at the first location. According to aspects and embodiments, the hollow optical pipe comprises nickel. According to aspects and embodiments, the hollow optical pipe is internally lined with a highly reflective coating. According to aspects and embodiments, the highly reflective coating comprises a layer of gold. According to aspects and embodiments, the hollow optical pipe has an outer diameter of less than 1 mm. According to aspects and embodiments, the hollow optical pipe has an inner diameter in a range between 0.25 m and 0.75 mm. According to aspects and embodiments, the distal end of the optical fiber is fed through the feed port of the fifth wall of the orthomode transducer and is disposed substantially at the first location.

According to aspects and embodiments, the waveguide radiator comprises a series of slots in a wall of the multimode waveguide radiator that are substantially invisible in the E-plane to the first signal and that provide for coupling the second and third signals into the waveguide radiator. According to aspects and embodiments, the waveguide radiator comprises a mirror disposed within the waveguide radiator at substantially a 45 degree angle to the wall comprising the series of slots. According to aspects and embodiments, the minor is etched to reflect the second signal at the second wavelength and the third signal at the third wavelength along a longitudinal axis of the waveguide radiator. According to aspects and embodiments, the waveguide radiator comprises collimating optics disposed within the waveguide radiator that collimates the second signal to substantially the first location as a second spherical wave with substantially the first phase center and collimates the third signal to substantially the first location as a third spherical wave with substantially the first phase center. According to aspects and embodiments, the multimode radiation source further comprises a mirror disposed outside the waveguide radiator at substantially a 45 degree angle to the wall comprising the series of slots. According to aspects and embodiments, the minor is etched to reflect the second signal at the second wavelength and is configured to be transparent to the third signal at the third wavelength.

According to one embodiment, a multimode radiation source comprises a waveguide radiator, a first transmission medium and a second transmission medium. The waveguide radiator has a first feed port for receiving a first signal and for providing the first signal to the waveguide radiator so that the waveguide radiator radiates the first signal at a first location as a first spherical wave with a first phase center. The first transmission medium is configured to be coupled to a first source and is coupled to the first feed port of the waveguide radiator, to receive the first signal and to provide the first signal to the first feed port of the waveguide radiator. The second transmission medium is configured to be coupled to a second source and to provide a second signal to the waveguide radiator so that the waveguide radiator radiates the second signal from substantially the first location as a second spherical wave with substantially the first phase center. The second transmission medium is further configured to be coupled to a third source and to provide a third signal to the waveguide radiator so that the waveguide radiator radiates the third signal from substantially the first location as a third spherical wave with substantially the first phase center.

According to one embodiment, a multimode radiation source comprises a waveguide radiator, a first transmission medium and a second transmission medium. The waveguide radiator is constructed and arranged to have a primary mode of operation over a first frequency range, has a first feed port for receiving a first signal within the first frequency range and for providing the first signal to the waveguide radiator so that the waveguide radiator radiates the first signal at a first location as a first spherical wave with a first phase center. The first transmission medium is configured to be coupled to a first source and is coupled to the first feed port of the waveguide radiator. The first transmission medium is configured to receive the first signal at a first frequency and a first wavelength from the first source and to provide the first signal to the first feed port of the waveguide radiator so as to launch the first signal in the waveguide radiator. The second transmission medium is disposed at least in part within the waveguide radiator. The second transmission medium is configured to receive a second signal at a second wavelength and a second frequency that is a plurality of orders of magnitude above the first frequency of the first signal and that is above the first frequency range of the waveguide radiator and is configured to propagate the second signal within the waveguide radiator and to radiate the second signal from substantially the first location as a second spherical wave with substantially the first phase center. The second transmission medium is further configured to receive a third signal at a third wavelength and a third frequency that is a plurality of orders of magnitude above the first frequency of the first signal and that is above the first frequency range of the waveguide radiator and is configured to propagate the third signal within the waveguide radiator and to radiate the third signal from substantially the first location as a second spherical wave with substantially the first phase center.

According to one embodiment, a multimode radiation source comprises a waveguide radiator, an orthomode transducer, and a transmission medium. The waveguide radiator is configured to receive a first signal at a first end of the waveguide radiator, to propagate the first signal along a transmission length of the waveguide radiator and to radiate the first signal at a first location at substantially a second end of the waveguide radiator as a first spherical wave with a first phase center. The orthomode transducer is coupled to the waveguide radiator at the first end of the waveguide radiator and configured to provide the first signal to the waveguide radiator. The orthomode transducer has a first port configured to receive the first signal having a first polarization and a second port configured to receive the first signal having a second polarization, wherein the first and second polarizations are orthogonal. The orthomode transducer has a first wall orthogonal to the first and second ports and orthogonal to a transmission length of the waveguide radiator. The first wall of the orthomode transducer comprises a third port for receiving a transmission medium. The transmission medium is coupled to the waveguide radiator through the third port. The transmission medium is configured to provide a second signal so that the waveguide radiator radiates the second signal from substantially the first location as a second spherical wave with substantially the first phase center. The second transmission medium is further configured to provide a third signal so that the waveguide radiator radiates the third signal from substantially the first location as a third spherical wave with substantially the first phase center.

According to one embodiment, a multimode radiation source comprises a waveguide radiator, a first source, a first transmission medium, a second source, a second transmission medium, a third source, and a third transmission medium. The waveguide radiator has a first feed port, has a primary mode of operation over a first frequency range, and is configured to radiate the first signal at a first location as a spherical wave with a first phase center. The first source is configured to provide a first signal at a first frequency and a first wavelength that is within the first frequency range of the waveguide radiator. The first transmission medium is coupled to the first source and to first feed port of the waveguide radiator and provides the first signal from the first source to first feed port of the waveguide radiator. The second source is configured to provide a second signal at a second wavelength and a second frequency that is a plurality of orders of magnitude above the first frequency of the first source and that is above the first frequency range of the waveguide radiator. The second transmission medium is coupled to the second source and is configured to provide the second signal to the waveguide radiator at the first location so as to radiate the second signal from substantially the first location as a spherical wave with substantially the first phase center. The third source is configured to provide a third signal at a third wavelength and a third frequency that is a plurality of orders of magnitude above the first frequency of the first source and that is above the first frequency range of the waveguide radiator. The third transmission medium is coupled to the third source and is configured to provide the third signal to the waveguide radiator at the first location so as to radiate the third signal from substantially the first location as a spherical wave with substantially the first phase center.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

As is known in the art, a multimode radiation source may include a number of spatially distributed discrete signal sources that provide multiple wavelength signals. However, such sources don't provide multiple sources radiating multiple signals from a first location with substantially a common phase center. Accordingly, aspects and embodiments of this disclosure are directed to a providing a multimode signal source that radiates multiple signals from a first location with substantially a common phase center. In particular, aspects and embodiments disclosed herein provide for at least two signal sources to be co-located, co-aligned so that the at least two signals are radiated in a same direction, and that provide at least two signals that are radiated with substantially a common phase center.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Figure 1:
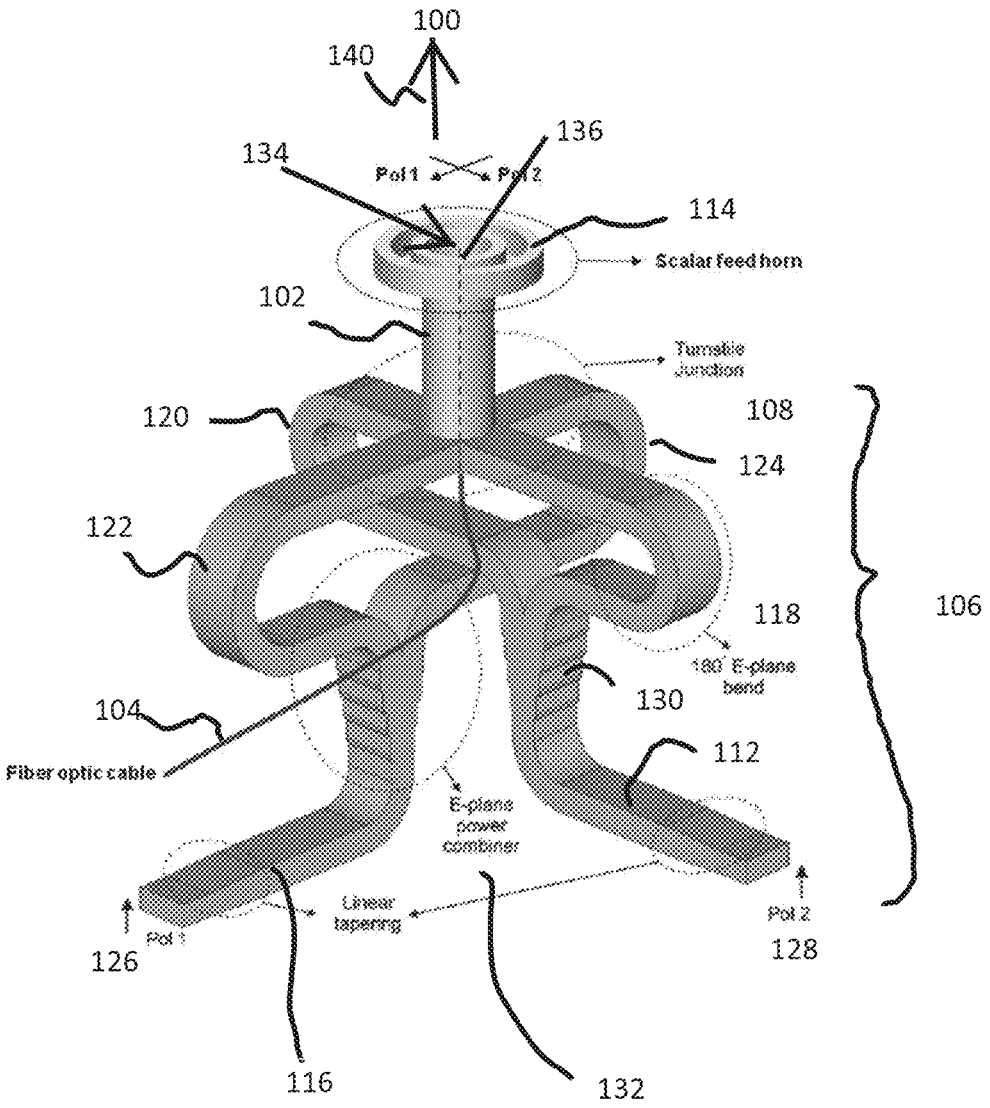
FIG. 1 is a view of a multimode source according to one embodiment of the disclosure.

FIG. 1 illustrates one embodiment of a multimode antenna 100 according to aspects and embodiments of the disclosure. This and other embodiments disclosed herein provide a common, multiple band signal source that provides at least two or more co-aligned, spherical waves when the multimode antenna is either placed at a focal point of collimating optics or placed in a far field from a device that will received the multiple signals. In particular, the multi-mode antenna includes frequency band signal sources that are co-located so as to radiate from the same location in space, that are co-aligned so that the sources are radiating in the same direction, and that radiate at least two or more co-aligned, spherical waves with the same phase center. For example, one embodiment of a multimode source according to the disclosure can provide an infrared (IR) plane wave signal, a semi-active laser (SAL) plane wave signal and any of a radio frequency (RF) plane wave signal or microwave (μW) frequency plane wave signal or millimeter wave (mmW) plane wave signal with a common phase center.

One embodiment of the multimode antenna 100 illustrated in FIG. 1 comprises an circular waveguide horn radiator 102 having corrugations and/or aperture choke rings 114 that comprises a scalar circular waveguide horn radiator producing a radiation pattern with a single phase center and equal beam widths in all planes (both E and H planes). According to aspects of this embodiment, multiple frequency band signals are provided to a common feed point of the circular waveguide antenna so as to produce multiple frequency radiation signals with a single phase center. The multimode antenna 100 comprises a manifold 106 that provides any of an RF, a μW, or a mmW signal to the circular waveguide horn radiator 102. The multimode antenna 100 also comprises a fiber optical cable 104 that can provide one or more of IR and SAL signals to the circular waveguide horn radiator 102. It is to be understood that the manifold and the fiber optic cable are coupled to respective sources (not illustrated) that provide the RF, μW, mmW, IR and SAL signals. It is also contemplated that the RF, μW, IR and SAL signal sources could be located within the waveguide horn radiator 102 so as to eliminate the need for the manifold 106 that provides any of an RF, a μW, or a mmW signal to the circular waveguide horn radiator 102 or the fiber optical cable 104 that provides one or more of IR and SAL signals to the circular waveguide horn radiator 102.

The illustrated embodiment of the manifold 106 includes an orthomode transducer (OMT) 108, a first polarization signal waveguide feed 112 and a second polarization signal waveguide feed 116. The waveguide manifold 106 provides signals having a first polarization and a second polarization as provided at feed ports 126, 128 to the waveguide horn radiator 102. It is to be appreciated that although the feed network is illustrated as a waveguide feed network, the feed network may be implemented using any suitable transmission medium technology, such as microstrip, stripline, coaxial cable, and other mediums know to those of skill in the art.

The OMT 108 can receive an input signal having a first amplitude and a polarization at the first port 126 and a second input signal having a second amplitude and a second polarization, which is orthogonal to the first polarization, at the second port 128 to provide a combined signal to the waveguide horn radiator 102. The OMT 108 combines the first polarization signal with the second polarization signal and provides the combined signal to the circular waveguide radiator 102. It is understood that the amplitude and phase of the two orthogonal polarization signals can be varied to provide various polarization signals such as a right hand polarization (RHP), left hand polarization (LHP) and circular polarization signal to be transmitted by the waveguide horn radiator 102.

Figure 2:
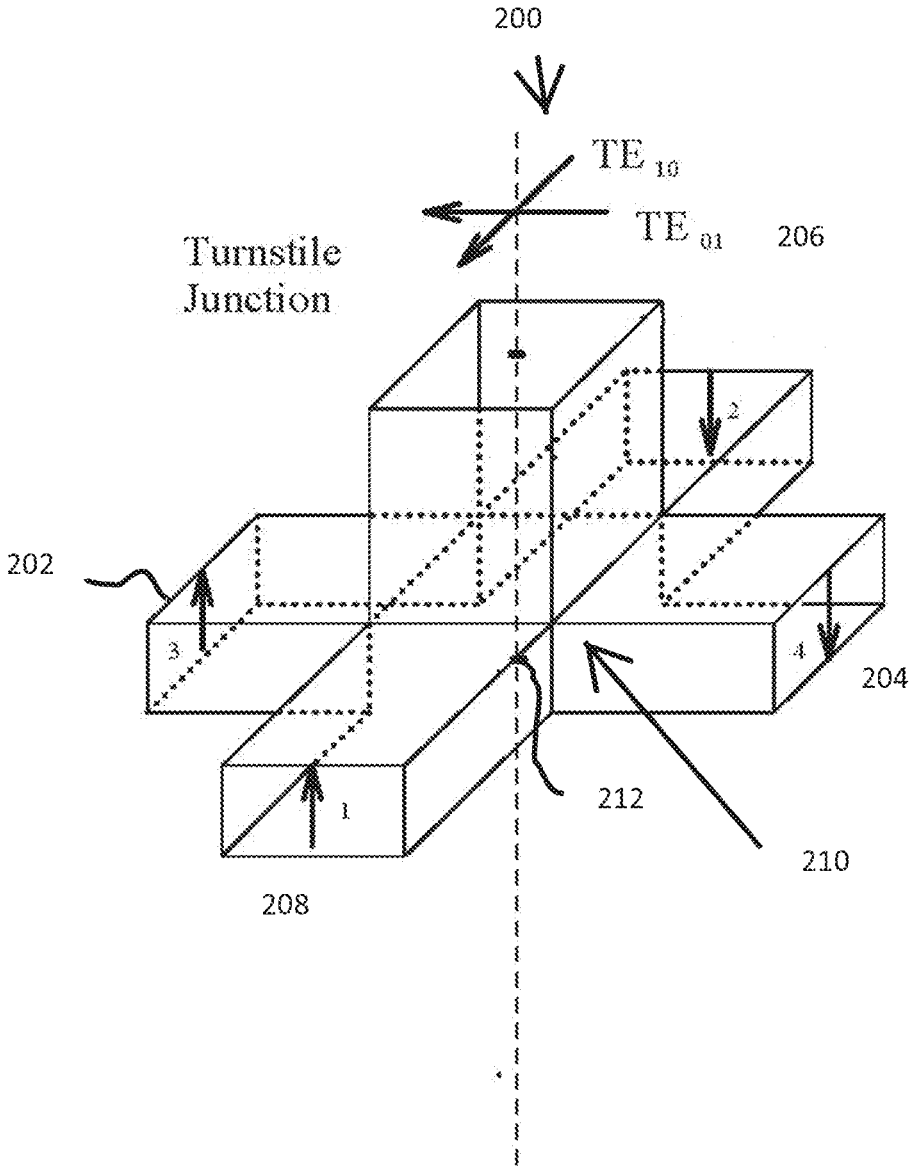
FIG. 2 is a view of a turnstile junction orthomode transducer that can be used in at least one embodiment of multimode source of the disclosure.

Referring now to FIG. 2, one embodiment of an orthomode transducer 200 used as the OMT 108 in the multimode antenna 100 of FIG. 1, is a turnstile junction orthomode transducer. The turnstile junction orthomode transducer 200 has a first port 202 and a second port 204 that receive first TE01 mode signal having a first phase and second TE01 mode signal having a second, opposite phase to the first phase. The first and second TE01 mode signals can be provided by a first symmetrical waveguide feed 112 as illustrated in FIG. 1. In particular, the first waveguide feed 112 receives the second polarization signal (POL 2) at the port 128, divides the second polarization signal with a power divider 130 into the first and second TE01 mode signals. The first waveguide feed comprises unequal lengths of waveguide 118 and 120 that provide opposite phase signals as the first and second TE01 mode signals. The first and second TE01 mode signals are provided through waveguide feed network 112 to the respective ports 202 and 204 of the turnstile junction orthomode transducer 200.

The turnstile junction orthomode transducer 200 also has a third port 206 and a fourth port 208 that receive a first TE10 mode signal having a first phase and a second TE10 mode signal having a second, opposite phase. Similar to the first symmetrical waveguide feed 112, the manifold 106 also includes a second waveguide feed 116 that receives the first polarization signal (POL 1) at the port 126, and divides the first polarization signal with power divider 132 into the first and second TE10 mode signals. The second waveguide feed also comprises unequal lengths of waveguide 122 and 124 that provide opposite phase signals as the first and second TE10 mode signals. The first and second TE10 mode signals are provided through the waveguide feed network 116 to respective ports 206 and 208 of the turnstile junction orthomode transducer 200. Thus, according to aspects of this embodiment each of the orthogonally polarized component signals TE01 and TE10 may travel a separate path from the ports 126, 128 to the corresponding feed ports 202, 204, 206, 208 of the OMT 200, wherein they are combined. According to illustrated embodiment, the feed paths may be non-symmetrical including a same number of E-plane bends and junctions such that the manifold feed network 106 does impart an opposite phase to the first and second polarization signals.

It is to be appreciated that according to aspects of this disclosure, other types of orthomode transducers such as, for example, a quadridged OMT, a boifot junction OMT, or any other OMT known to those of skill in the art can be used. It is further to be appreciated that the OMT need not have opposite phase, same polarization feed ports, but instead can have only two orthogonal input ports (TE01 and TE10) instead of four. Similarly, the manifold feed network 106 need not have symmetrical opposite phase feeds lengths to feed opposite phase ports of the same polarization, but instead can have single phase feed lengths of opposite polarization, such as feed ports 118 and 122 (listed as E-bends earlier) as illustrated in FIG. 1. Further, the feed paths could also be symmetrical including a same number of E-plane bends and junctions such that the manifold feed network 106 imparts no phase imbalance to the first and second polarization signals. Further, the OMT may be excluded completely if only one polarization is required.

Referring to FIG. 2, the illustrated embodiment of the turnstile junction orthomode transducer 200 further comprises a hole 212 in a wall 210 of the OMT, through which can be provided the fiber optical cable 104 as illustrated in FIG. 1. One advantage of using the turnstile junction orthomode transducer 200 according to aspect of this embodiment is that the fiber optical cable fed through the hole 212 in the wall 210 of the OMT does not substantially affect the RF, μW, or mmW signal that results from the signals fed to ports 202, 204, 206 and 208 of the turnstile junction orthomode transducer 200. Thus, as illustrated in FIG. 1, the fiber optic cable 104 can be fed through the wall 210 of the OMT such that an end the fiber optic cable 134 (shown in phantom) is located at a feed point 136 of the circular waveguide antenna. The feed point 136 of the circular waveguide antenna is substantially the same feed point for the RF, μW, or mmW signal that is radiated by the circular waveguide antenna. Thus, the fiber optic cable can provide either or both of an IR and SAL signal to the feed point 136, and the combination of the manifold 106, turnstile junction OMT 108, and circular polarization feed horn 102 provide any of an RF, μW, or mmW signal to the same common feed point. With this arrangement, the multi-mode source can radiate multiple frequency band signals that are co-located so that they are radiating from the same feed location 136, that are co-aligned so that they are radiating in the same direction 140, and that are radiating with substantially a same phase center. For example, referring to FIG. 3, according to one embodiment, the multimode source may simultaneously provide an infrared signal 304, a semi-active laser signal 308 and a millimeter wave signal 306 radiated from the circular waveguide antenna as plane waves.

Referring again to FIG. 1, in one embodiment the multimode antenna 100 comprises the fiber optical cable 104 that is fed through the hole 212 in the wall 210 of the OMT, and the fiber optic cable is further fed into the circular waveguide horn radiator 102 so that the end 134 of the fiber optic cable (shown in phantom) is maintained at the waveguide feed point 136 of the circular waveguide antenna. According to aspects of this disclosure, the fiber of the fiber optic cable 104 can be made of Indium-Fluoride or any other suitable material for propagating an IR signal and a SAL signal. For example, one embodiment comprises a CorActive supplied part number FCA-SE-100/170-2-C-FC-FC, IR Fiber Optic-FC/PC Cable, which includes Arsenic Triselenide optical fiber surrounded by a sheath that maintains the IR and SAL signals within the fiber optical cable and propagates these signals along the fiber optic cable. It is to also be appreciated that the fiber end 134 of the fiber optic cable 104 can be treated, for example, rounded and polished to provide spherical wave front signals radiated by the optical fiber 104. Further, it is to be appreciated that the fiber is held in place within the circular waveguide horn 102 so that the end 134 of the fiber optic cable (shown in phantom) is maintained at the waveguide feed point 136 of the circular waveguide antenna. According to aspects of this disclosure, the fiber optic cable can be held in place by a low dielectric constant foam jacket that surrounds the fiber optic cable and provided structural rigidity to the fiber optic cable so as to maintain it in such position. The low dielectric constant foam jacket can be made of a material that is substantially invisible to the RF, μW or mmW signal that is propagating in the circular waveguide antenna. Alternatively, or in addition, Teflon sleeves or other periodic rigid structures such as discs that are substantially transparent to RF, μW or mmW signals known to those of skill in the art, can be used to hold the fiber optic cable 104 in place so that the end of the fiber optic cable 134 (shown in phantom) is maintained at a feed point 136 of the circular waveguide antenna.

Figure 5:
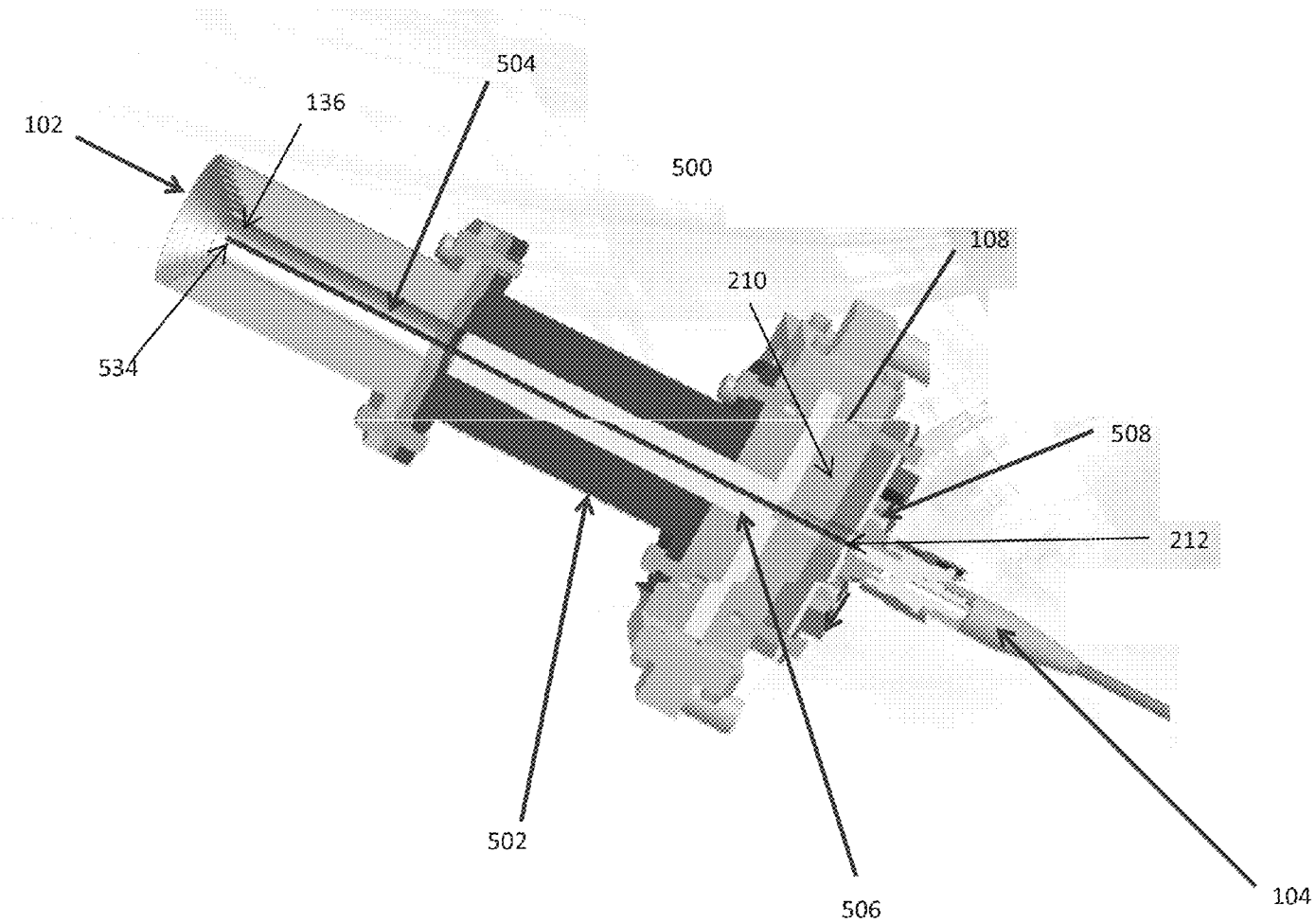
FIG. 5 illustrates another embodiment of the multimode antenna.

Referring to FIG. 5, in another embodiment of the multi-mode antenna 500, the fiber optical cable 104 is coupled to an optical pipe 504 that is fed through the hole 212 in the wall 210 of the OMT 108. The optical pipe 504 is disposed in the circular waveguide horn radiator 102 so that an end 534 of the optical pipe is maintained at the waveguide feed point 136 of the circular waveguide antenna and such that an emitting facet of the optical pipe 504 will be substantially coincident with the phase center of the waveguide horn radiator 102. This embodiment of the multimode antenna 500 may also, but need not, include a waveguide extension 502 coupled and disposed between the OMT 108 and the waveguide horn radiator 102.

According to aspects of embodiments of this disclosure, the optical pipe 504 can be a hollow tube made of a rigid material (such as Nickel) that is lined with a highly-polished broadband reflective coating (such as Laser Gold) to enable highly efficient broadband optical transmission. For example, the optical pipe can be a custom part supplied by Epner Technology and having part number SP8805761, which is a GOLD Nickel Light pipe having a 500 um ID, a 1000 um OD, and a 121 mm length. According to aspects of this disclosure, the optical pipe 504 can comprise an outer diameter ("OD") in a range of OD<1 mm in order to be substantially invisible to the MMW RF signal in the circular waveguide (as found in measurement and analysis), and which is also a sufficiently large internal diameter ("ID") in a range of 0.25 mm<ID<0.75 mm to allow multiple optical signals to transmit down the optical pipe 504. In other words, the optical pipe can transmit multiple optical signals along the pipe as fed to it by the optical fiber 104 to distal end 534 of the optical pipe disposed at the waveguide feed point 136 of the circular waveguide antenna such that the emitting facet of the optical pipe 504 will be substantially coincident with the phase center of the waveguide horn radiator 102. In such embodiment, the optical pipe configured to have a length that is in a range 50 mm<length<150 mm, which is long enough to homogenize the optical signals fed to the optical pipe 504 so as to avoid pupil artifacts, yet short enough to be substantially invisible to the MMW RF signal. The geometrical nature of the light pipe 504 also integrates the optical signals input to the light pipe 504 independent of launch conditions or errors, providing uniform illumination at the emitting facet of the light pipe 504.

Further, it is to be appreciated that optical pipe 504 is held in place within the circular waveguide horn 102 so that the end 534 of the optical pipe 504 is maintained at the waveguide feed point 136 of the circular waveguide antenna. According to aspects of embodiments of this disclosure, the optical pipe 504 can be held in place by a low dielectric syntactic foam 506 that surrounds the optical pipe 504 and provides structural rigidity to the optical pipe 504 so as to maintain it in such position. The low dielectric syntactic foam can be made of a material that is substantially invisible to the RF, μW or mmW signals propagating in the circular waveguide antenna. Alternatively, or in addition, any of Teflon sleeves or other periodic rigid structures such as discs that are substantially transparent to RF, μW or mmW signals can be used to hold the optical pipe 504 in place so that the end of the optical pipe 504 is maintained at a feed point 136 of the circular waveguide antenna. It is to be understood that any of such structures are provided in the Horn to minimize dielectric interference with the RF signal propagated by the horn itself. Such structures (such as shims) can also be provided in the Horn to allow the optical pipe 504 to maneuver along the common electrical/optical axes (any and all of x/y/z axis) of the Horn in order to align the phase center of the optical pipe with the MMW RF emissions of the horn 102.

Figure 6:
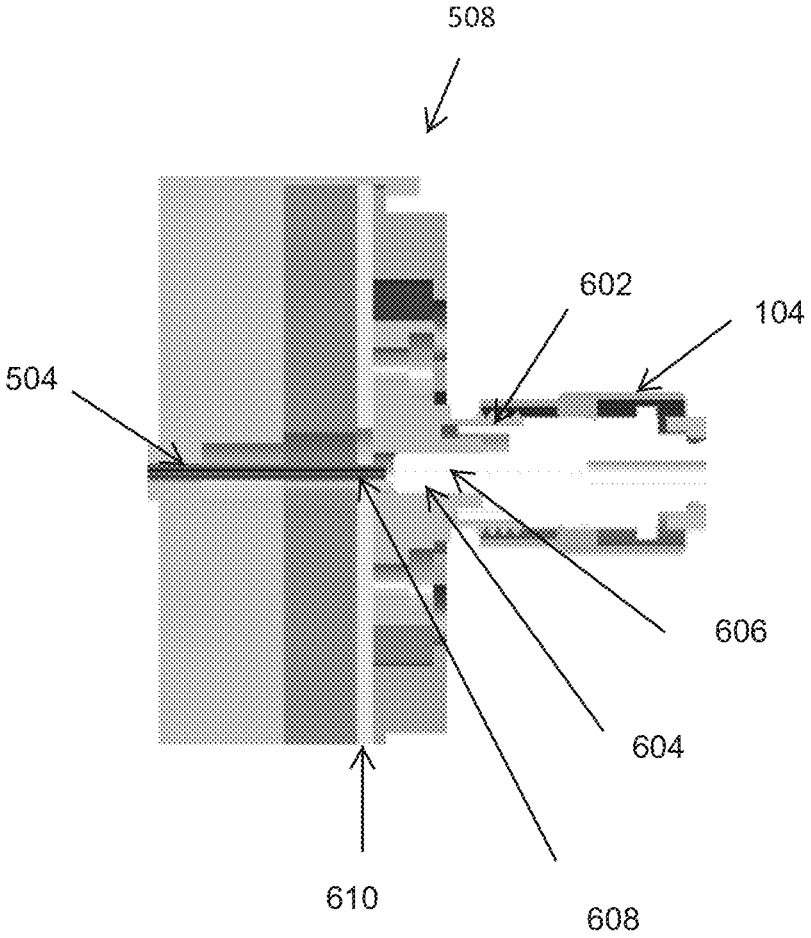
FIG. 6 illustrates an exploded view of one embodiment of an optical coupler coupling optical signals from a fiber optic cable to an optical pipe.

According to aspects of embodiments of this disclosure, there is provided an optical coupler 508 in the wall 210 of the OMT 108 to couple the standard optical fiber cable 104 and optical signals from the optical fiber cable 104 to the optical pipe 504. Referring to FIG. 6, there is illustrated an exploded view of the optical coupler 508 coupling the optical signals from the fiber optic cable 104 to the optical pipe 504. The fiber optic cable 104 mates with a fiber adapter 602 so as to place a ferrule end 604 of the fiber 606 in close proximity to an end 608 of the optical pipe 504, so as to couple the optical signals propagating in the fiber optic cable 104 to the optical pipe 504. It is to be appreciated that the optical coupler can be adapted to adjust the proximity of the ferrule end 604 of the fiber 606 to the end 608 of the optical pipe 504, for example with a shim 610. In one embodiment the shim 610 comprises a plurality of layers of thin shim layers that can be peeled away so as to adjust the thickness of the shim. It is also to be appreciated that a plurality of shims of the same or varying thickness can be used to adjust the proximity of the ferrule end 604 of the fiber 606 to the end 608 of the optical pipe 504. Also, as noted above, the optical pipe 504 in one embodiment has an inner diameter in a range between 0.25 m and 0.75 mm so as to allow multiple optical signals to be fed from the end of the optical fiber 606 into the optical pipe 504.

It is to be understood that the various RF, μW, mmW, IR and SAL signals can be simultaneously or alternately radiated, and the signals can be radiated in any combination by controlling the signal sources that feed the feed ports 126, 128 of the manifold and the fiber optical cable 104. It is further to be appreciated that the signals can be amplitude and/or phase modulated signals to provide any of continuous wave (CW) signals, pulsed signals, and with various polarizations as will be readily apparent to one of skill in the art.

Figure 3:
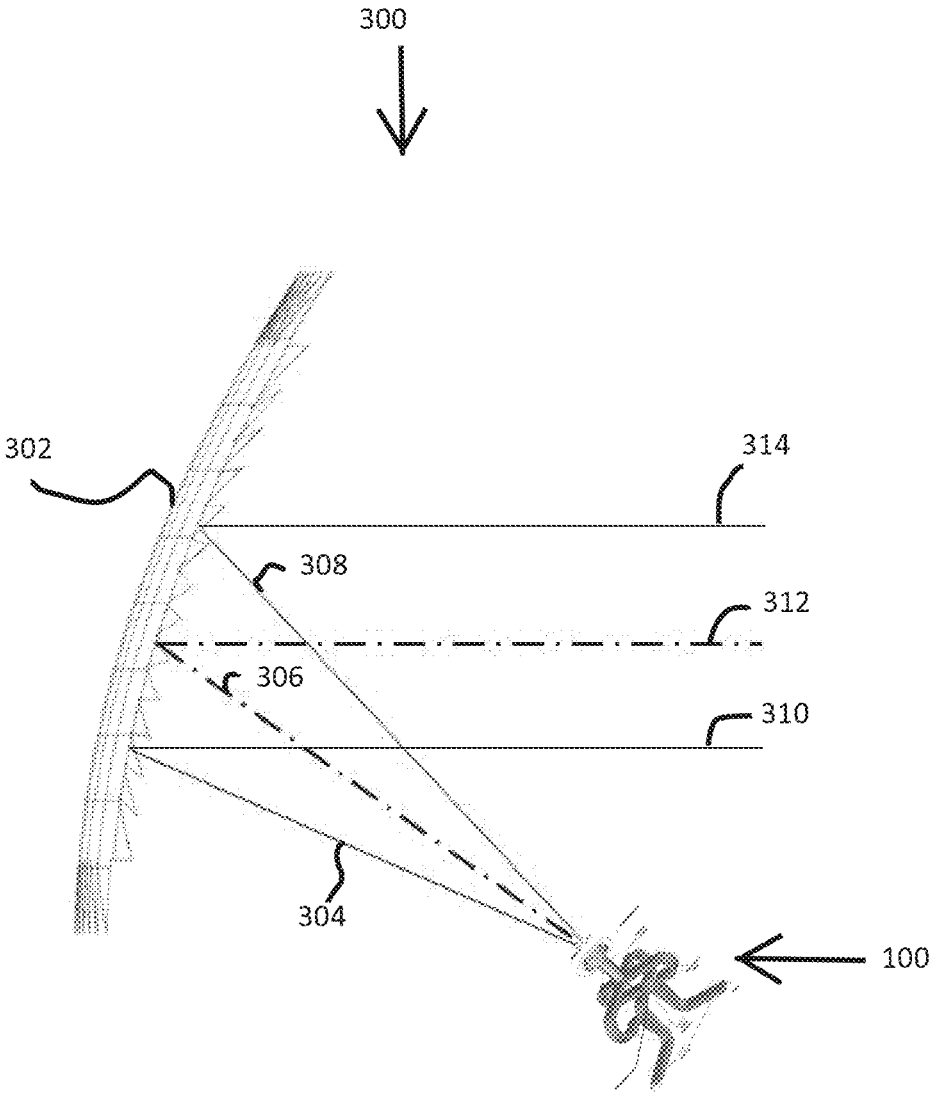
FIG. 3 is a view of a multimode source that can be used in a compact test range according to the disclosure.

Referring to FIG. 3, there is illustrated one embodiment of a multi-mode source 300 that can be used in a compact measurement range (not illustrated) according to aspects of this disclosure. The multi-mode source 300 comprises the multi-mode antenna 100 that radiates the RF, μW, mmW, IR and SAL signals to a multi-band signal reflector 302. As has been described herein, the multi-mode antenna feed 100 can be controlled to radiate, for example, an IR signal, a mmW signal, and an SAR signal as spherical waves with a common phase center, as shown by diverging rays 304, 306, 308. The common phase center, spherical wave signals 304, 306, and 308 are radiated towards the reflector 302, which reflects any of the RF, μW, mmW, IR and SAL signals as co-aligned plane wave signals, as shown by parallel rays 310, 312, 314. Thus, the combination of the multi-mode antenna 100 and the multi-band signal reflector 302 can be controlled to provide co-aligned plane wave signals 310, 312, 314 having various amplitude, phase and polarization characteristics. According to one aspect of this disclosure, the combination of the multi-mode antenna 100 and the multi-band signal reflector 302 can be used and controlled to provide co-aligned, plane wave signals 310, 312, 314 radiating with a common phase center for use in a compact test range (not illustrated) to test a UUT, such as a multimode seeker. It is to be appreciated that various uses exist for the combination of the multi-mode antenna 100 and the multi-band signal reflector 302 providing co-aligned, plane wave signals 310, 312, 314 radiating with a common phase center, as is readily apparent to one of skills in the art, and that such uses are contemplated by this disclosure.

Figure 4:
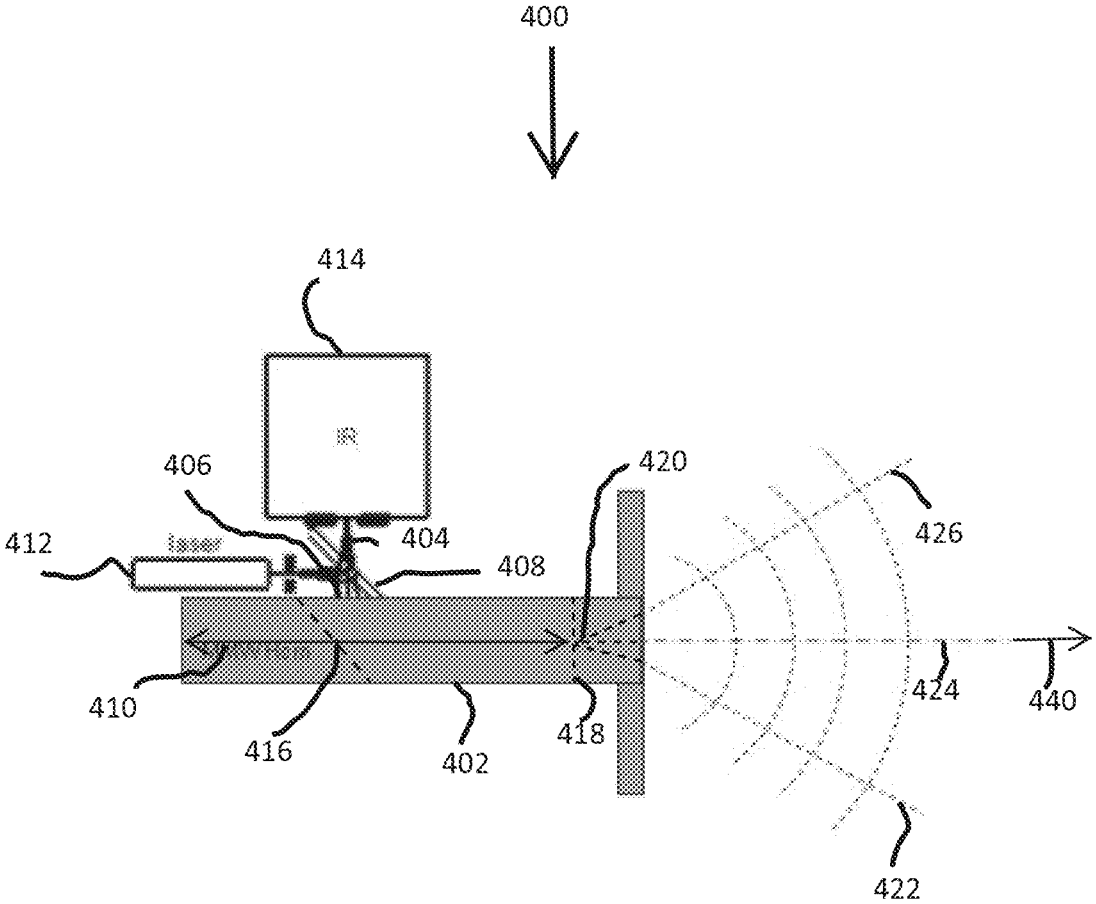
FIG. 4 is a view of a multimode source according to another embodiment of the disclosure.

Referring to FIG. 4, there is illustrated another embodiment of a multi-mode antenna 400 that can be used as disclosed herein. The multimode antenna 400 comprises a waveguide horn radiator 402. The waveguide horn radiator can be a circular horn radiator having corrugations and/or aperture choke rings, such as illustrated in FIG. 1, or any other waveguide horn radiator know to those of skill in the art. A preferred waveguide radiator will produce a radiation pattern with a single phase center and equal beam widths in all planes (E and H planes), with multiple frequency band signals provided to a common feed point of the waveguide radiator. The multimode antenna 400 further comprises a waveguide feed (not illustrated) such as a coaxial waveguide feed or any other feed known to one of skill in the art that can provide any of a RF, μW, or mmW signal to the waveguide horn radiator 402. The multimode antenna 400 also comprises another feed that provides one or more of an IR and SAL signal to the waveguide horn radiator 402.

According to one embodiment, the waveguide horn radiator 402 is modified to provide a hole, a slot, or a number of holes or slots in the E-plane of the waveguide horn radiator (not illustrated) through which can be injected a collimated IR free space wave front signal 404 and a collimated SAL free space wave front signal 406. The slot or slots can be cut in the E-plane of the waveguide horn radiator so as to be substantially invisible to the RF, μW or mmW signal that is propagating along the waveguide horn radiator 402. The multimode antenna 400 also comprises a first optical mirror 408, an SAL signal source 412, and an IR signal source 414, which are disposed outside the waveguide horn radiator 402. The first optical mirror 408 is positioned at approximately a 45° angle with respect to a longitudinal axis 410 of the waveguide horn radiator 402, so as to reflect the SAL signal 406 provided by the SAL signal source 412 through the slots or holes in the E-plane of the waveguide horn radiator. The first optical mirror 408 can be a dichroic minor also configured to be transparent to the collimated IR signal 404 provided by the IR signal source 414 so as to pass the collimated IR signal wave front 404 through the slots or holes in the E-plane of the waveguide horn radiator.

The multimode antenna 400 further comprises a second optical mirror 416 (shown in phantom), which is placed inside the waveguide horn radiator and is positioned at approximately a 45° angle with respect to a longitudinal axis 410 of the waveguide horn radiator 402 so as to reflect and collimate both the IR signal 404 and the SAL signal 406 down the waveguide longitudinal axis. According to aspects of this embodiment, the second optical mirror can also be configured to be transparent to the RF, μW or mmW signal propagating in the waveguide horn radiator and to be reflective of the IR and SAL signals. The waveguide horn radiator 402 can also be provided with a dual frequency lens 418 (illustrated in phantom), which is transparent to the RF, μW or mmW signal, and that is placed in the cross section of the waveguide in the path of the IR and SAL wave fronts. The optical lens 418 is further configured to focus the IR and SAL wave fronts to a common focal point 420 that is coincident with the RF, μW, or mmW phase center of the waveguide horn 402. According to aspects of this disclosure the optical lens can be a dual frequency holographic lens, a Gaussian beam lens, or other lens known to those of skill in the art.

With this arrangement, the waveguide horn radiator 402 can radiate multiple frequency band signals that are co-located so that they are radiating from the same feed location 420, that are co-aligned so that they are radiating in the same direction 440, and that are radiating with a same phase center. For example, according to one embodiment, the multimode source may simultaneously provide an infrared signal, a semi-active laser signal and a millimeter wave signal radiated from the waveguide horn radiator 402 as spherical waves, as shown by diverging rays 422, 424, and 446. It is to be appreciated that according to one embodiment of the disclosure, a multi-mode source comprises the waveguide horn radiator 402 to feed the multi-band signal reflector 302 illustrated in FIG. 3. Thus, according to aspect of this embodiment, waveguide horn radiator 402 can produce three simultaneous, co-aligned spherical waves for use, for example, in a compact antenna range for illumination of a UUT such as a multimode seeker under test.

It is further to be understood that the various signals 422, 424, 426 provided by the waveguide horn radiator 402 can be radiated simultaneously or alternately, and can be radiated in any combination by controlling the signal sources 412, 414 and the RF, μW, or mmW signal source that feeds the waveguide horn radiator 402 (not illustrated). It is further to be appreciated that the signals can be amplitude and/or phase modulated to provide any of continuous wave (CW) signals, pulsed signals, and with signals with various polarizations as will be readily apparent to one of skill in the art.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A multimode radiation source, comprising:

a waveguide radiator having a first feed port for receiving a first signal having a first wavelength in a radio frequency (RF) band and for providing the first signal to the waveguide radiator so that the waveguide radiator radiates the first signal at a first location as a first spherical wave with a first phase center;

waveguide feed network configured to be coupled to an RF source and that is coupled to the first feed port of the waveguide radiator, the waveguide feed network configured to receive the first signal from the RF source and to provide the first signal to the first feed port of the waveguide radiator;

a hollow optical pipe having a distal end that is disposed substantially at the first location such that an emitting facet of the hollow optical pipe is substantially coincident with the first phase center, the hollow optical pipe configured to be coupled to a first optical source and configured to receive a second signal having a second wavelength in an optical band from the first optical source and to provide the second signal to the waveguide radiator so that the waveguide radiator radiates the second signal from substantially the first location as a second spherical wave with substantially the first phase center; and the hollow optical pipe further configured to be coupled to a second optical source that is configured to provide a third signal having a third wavelength in the optical band, and to provide the third signal to the waveguide radiator so that the waveguide radiator radiates the third signal from substantially the first location as a third spherical wave with substantially the first phase center.

2. The multimode radiation source as claimed in claim 1, wherein the waveguide radiator is a circular waveguide radiator.

3. The multimode radiation source as claimed in claim 2, wherein the circular waveguide radiator is a scalar ring feed horn that comprises annular choke rings.

4. The multimode radiation source as claimed in claim 1, wherein the waveguide feed network includes a waveguide orthomode transducer coupled to the waveguide radiator at the first feed port of the waveguide radiator and configured to provide the first signal to the waveguide radiator, the orthomode transducer having a first port in a first wall of the orthomode transducer configured to receive the first signal having a first E-plane polarization, the orthomode transducer having a second port in a second wall of the orthomode transducer that is orthogonal to the first wall and configured to receive the first signal having a second E-plane polarization, wherein the first and second E-plane polarizations are orthogonal, and wherein the waveguide orthomode transducer has a third wall orthogonal to each of the first and second walls and that has a feed port for the hollow optical pipe disposed therein.

5. The multimode radiation source as claimed in claim 4, wherein the waveguide orthomode transducer is a turnstile junction waveguide orthomode transducer wherein the first port comprises first and third waveguide ports having the first E-plane polarization disposed in the first wall and an opposite fourth wall of the waveguide orthomode transducer, and wherein the second port comprises second and fourth waveguide ports having the second E-plane polarization disposed in the second wall and an opposite fifth wall of the waveguide orthomode transducer that are orthogonal to the first and fourth walls, and wherein the third wall that has the feed port for the hollow optical pipe disposed therein is orthogonal to each of the first, second, fourth, and fifth walls.

6. The multimode radiation source as claimed in claim 4, wherein the waveguide feed network comprises a first waveguide having a first E-plane polarization coupled to the first port of the waveguide orthomode transducer and a second waveguide having a second E-plane polarization coupled to the second port of the waveguide orthomode transducer.

7. The multimode radiation source as claimed in claim 1, further comprising an optical fiber coupled to the hollow optical pipe and to the first and second optical sources and configured to feed the second and third signals into the hollow optical pipe.

8. The multimode radiation source as claimed in claim 1, wherein the hollow optical pipe is internally lined with a highly reflective coating.

9. The multimode radiation source as claimed in claim 8, wherein the highly reflective coating comprises a layer of gold.

10. A multimode radiation source, comprising:

a waveguide radiator constructed and arranged to have a primary mode of operation over a radio frequency (RF) frequency range, the waveguide radiator having a first feed port for receiving an RF signal within the RF frequency range and for providing the RF signal to the waveguide radiator so that the waveguide radiator radiates the RF signal at a first location as a first spherical wave with a first phase center;

waveguide feed network configured to be coupled to an RF source and that is coupled to the first feed port of the waveguide radiator, the waveguide feed network configured to receive the RF signal from the RF source and to provide the RF signal to the first feed port of the waveguide radiator so as to launch the RF signal in the waveguide radiator; and a hollow optical pipe disposed at least partially within the waveguide radiator and having a distal end that is disposed substantially at the first location, the hollow optical pipe configured to receive a first optical signal at a first frequency that is a plurality of orders of magnitude above a frequency of the RF signal and that is above the RF frequency range and a second optical signal at a second frequency that is also a plurality of orders of magnitude above the frequency of the RF signal and that is above the RF frequency range, the hollow optical pipe being configured to propagate the first and second optical signals within the waveguide radiator, to radiate the first optical signal from substantially the first location as a second spherical wave with substantially the first phase center, and to radiate the second optical signal from substantially the first location as a second spherical wave with substantially the first phase center.

11. The multimode radiation source as claimed in claim 10, wherein the waveguide radiator is a circular waveguide radiator.

12. The multimode radiation source as claimed in claim 11, wherein the circular waveguide radiator is a scalar ring feed horn that comprises annular choke rings.

13. The multimode radiation source as claimed in claim 10, wherein the waveguide feed network includes a waveguide orthomode transducer coupled to the waveguide radiator at the first feed port of the waveguide radiator and configured to provide the RF signal to the waveguide radiator, the orthomode transducer having a first port in a first wall of the orthomode transducer configured to receive the RF signal having a first E-plane polarization, the orthomode transducer having a second port in a second wall of the orthomode transducer that is orthogonal to the first wall and configured to receive the RF signal having a second E-plane polarization, wherein the first and second E-plane polarizations are orthogonal, and wherein the waveguide orthomode transducer has a third wall orthogonal to each of the first and second walls and that has a feed port for the hollow optical pipe disposed therein.

14. The multimode radiation source as claimed in claim 13, wherein the waveguide orthomode transducer comprises a turnstile junction waveguide orthomode transducer wherein the first port comprises first and third waveguide ports having the first E-plane polarization disposed in the first wall and an opposite fourth wall of the waveguide orthomode transducer, and wherein the second port comprises second and fourth waveguide ports having the second E-plane polarization disposed in the second wall and an opposite fifth wall of the waveguide orthomode transducer that are orthogonal to the first and fourth walls, and wherein the third wall that has the feed port for the hollow optical pipe disposed therein is orthogonal to each of the first, second, fourth, and fifth walls.

15. The multimode radiation source as claimed in claim 13, wherein the waveguide feed network comprises a first waveguide having a first E-plane polarization coupled to the first port of the waveguide orthomode transducer and a second waveguide having a second E-plane polarization coupled to the second port of the waveguide orthomode transducer.

16. The multimode radiation source as claimed in claim 10, wherein the hollow optical pipe is internally lined with a highly reflective coating.

17. The multimode radiation source as claimed in claim 16, wherein the highly reflective coating comprises a layer of gold.

18. The multimode radiation source as claimed in claim 10, further comprising a dielectric syntactic foam surrounding the hollow optical pipe and configured to hold the hollow optical pipe in place with respect to the waveguide radiator.

19. The multimode radiation source as claimed in claim 10, wherein the hollow optical pipe has a length in a range of 50 mm to 150 mm.

20. The multimode radiation source as claimed in claim 19, wherein the hollow optical pipe has an outer diameter of less than 1 mm and an internal diameter in a range of 0.25 mm to 0.75 mm.

* * * * *

UNITED STATES PATENT AND TRADEMARK OFFICE

CERTIFICATE OF CORRECTION

PATENT NO. : 9,287,615 B2
APPLICATION NO. : 13/803402
DATED : March 15, 2016
INVENTOR(S) : David C. Cook et al.

It is certified that error appears in the above-identified patent and that said Letters Patent is hereby corrected as shown below:

In the Specification:
At column 5, line number 6, delete “minor” and replace with --mirror--.
At column 5, line number 19, delete “minor” and replace with --mirror--.
At column 13, line number 36, delete “minor” and replace with --mirror--.

Signed and Sealed this
Twenty-eighth Day of June, 2016

Michelle K. Lee

Michelle K. Lee
*Director of the United States Patent and Trademark Office*